United States Patent [19]

Roman

[11] 4,033,498

[45] July 5, 1977

[54] APPARATUS FOR STAPLING HEELS

[76] Inventor: Manuel Morales Roman, Angel Castana Martinez, 45 Elche, Alicante, Spain

[22] Filed: Jan. 12, 1976

[21] Appl. No.: 648,365

[30] Foreign Application Priority Data

July 5, 1974 Spain ..... 204415

[52] U.S. Cl. ..... 227/30; 227/120; 227/135

[51] Int. Cl.[2] ..... B27F 7/00

[58] Field of Search ..... 227/28, 29, 30, 120, 227/135, 137

[56] References Cited

UNITED STATES PATENTS

| | | | |
|---|---|---|---|
| 3,072,913 | 1/1963 | Morgan et al. | 227/135 X |
| 3,148,374 | 9/1964 | Bassford et al. | 227/135 |

*Primary Examiner*—Granville Y. Custer, Jr.
*Attorney, Agent, or Firm*—Eyre, Mann, Lucas & Just

[57] ABSTRACT

Staples are delivered to guides in a vertical column by a plurality of slides which move out of the way after the delivery. A boot or shoe and a heel to be stapled is fitted upside down over a heel-shaped last at the top of the column. A pneumatic cylinder and hammers force the staples through the guides and into the shoe and heel thereby attaching them together.

3 Claims, 6 Drawing Figures

APPARATUS FOR STAPLING HEELS

In order to staple heels or other elements to form items of footwear, machines are known which essentially comprise a column, the top of which forms a last designed to receive the item of footwear and which contains assembled inside it hammers which are displaceable longitudinally of the column and which operate rhythmically to displace staples along the column from lateral points of entry towards the upper end of the column, until at the end of their travel, the staples have been driven into the item of footwear.

In order to feed the staples into the column, the latter incorporates a number of radial elements which carry sets of staples and provide access to the lateral feed locations in the column so that the sliding hammers pick up the staples from the sets, when they are actuated, and carry them up to the top of the column to perform the work.

However, this logical arrangement possesses a major drawback since if the elements carrying the sets of staples are attached to the column adjacent to the top thereof, they will constitute an obstacle so far as the placing in position of the item of footwear is concerned, since the leg portion of the item may interfere with the elements and, consequently, such a machine will not be able to be used for the manufacture of items of footwear with a long leg portion, much less items such as boots. In order to be able to use these machines to manufacture boots and items of footwear having long leg portions, it is essential that the elements which carry the sets of staples should be attached to the column at points well removed from the top of the column, the latter being the position where the item of footwear is placed, so that they do not constitute an obstacle which can foul the leg of this type of footwear; however, such a solution has been found to be impractical because it makes it necessary for the hammers to have a long working travel between the point at which they pick up the staples from the lateral points of entry, to the point at which they drive the staples into the item of footwear, the large and disproportionate length of this travel creating a series of disadvantages such indeed as to make the machine unserviceable.

It is an object of the present invention to provide apparatus for stapling heels or other elements to items of footwear in which these disadvantages are overcome.

According to the invention, there is provided apparatus for stapling a heel or other element to an item of footwear, comprising a column the top of which is shaped to form a last to receive the item of footwear and which contains within it a plurality of longitudinally displacing hammers which operate to displace staples for attaching said heel or other element along the column from their lateral points of entry towards the upper end of the column where they are driven into the item of footwear, wherein for feeding staples into said column, a plurality of slides carrying sets of staples are mounted for movement towards and away from said column by individual displacement means acting to move said slides away from the column after the staples have been loaded, so that the item of footwear can be placed without hindrance on said column. In use, the displacement means urges the slides towards the column until they come up against the lateral openings therein, so that the staples are loaded into the column prior to the placing into position of the item of footwear, whilst the displacement means at the same time perform a return motion in order to displace the slides away from the column once these staples have been loaded into the column, the column then being totally free so enabling the item of footwear to be placed on it without the leg portion thereof encountering any obstacle, since the slides which carry the sets of staples have already moved away from the column and the column has already been loaded with staples for carrying out the stapling of the heel to the item of footwear.

In this logical way, all the problems of fouling and unsuitability inherent in the previous solution which constitute an obstacle to the leg portion of the item of footwear and to its placing in position on the column, are eliminated whilst, on the other hand, the working travel of the hammers which drive in the staples can now be made as short as required, since arrangement at one point or another has no secondary implications but simply involves the adaptation of the slides, with their displacement means, to this particular solution.

The invention will now be further described with reference to the drawings, in which.

Figure 1:
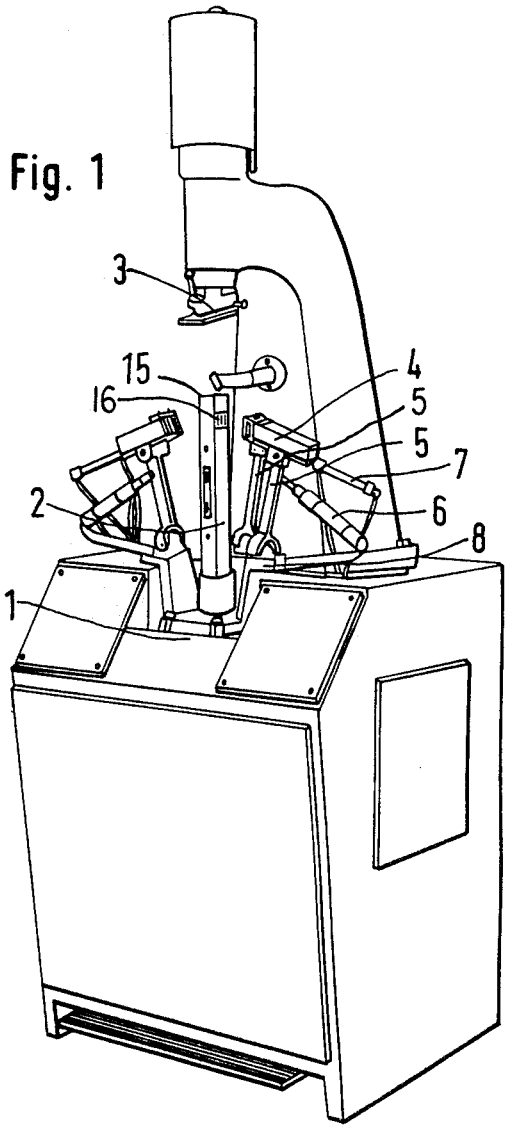
FIG. 1 is a perspective view of apparatus in accordance with the invenion.

Referring to FIG. 1, apparatus for stapling the heel or a similar element to an item of footwear comprises a main column 2 mounted on a stand 1, the column at its upper end 15 is shaped to conform to the counter portion of footwear, on which an item of footwear can be positioned in the inverted position, with the heel or other element which isto be stapled, superimposed thereon.

The column 2 is provided inside with a number of longitudinal guides housing corresponding hammers 14 (FIG. 3) operationally linked at pushrod 13 with displacement means constituted by a pneumatic cylinder (not shown) connected to the pushrod 12 in such a way that, during the working feed motion of the pushrod 12, the hammers 14 are displaced towards the top of the column, carrying with them appropriate staples for driving into the item of footwear in order to attach the heel to it. The apparatus includes an abutment 3 enabling proper stapling to take place when it is lowered onto the heel to hold it in position on the footwear, although once stapling has been completed, it can be rotated to one side so that the item of footwear can be removed freely.

Figure 2:
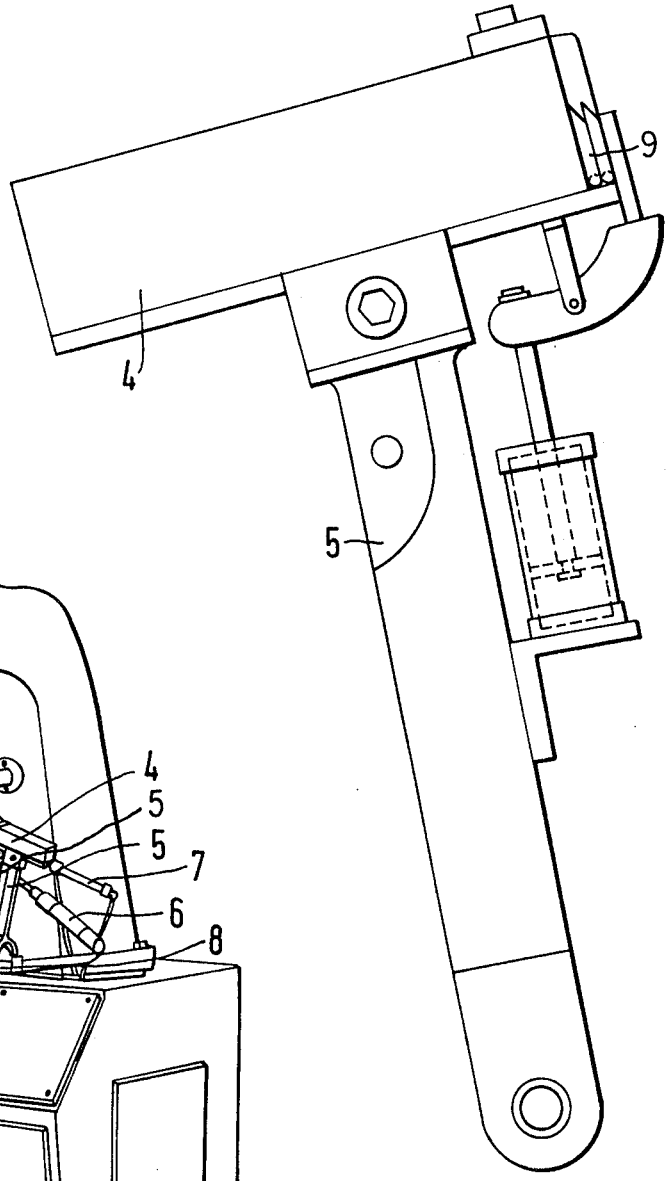
FIG. 2 is a front view of a part of the apparatus of FIG. 1, showing one staple feeding means in the initial position of the apparatus.

The supply of staples to the column is effected through simple lateral openings 16 formed in the column, and to effect this supply a plurality of slides 4 each of which carries a set of staples 9, is provided, the slides 4 being mounted in movable fashion in the apparatus, each slide being connected to a respective displacement means 6 and a respective loading means 7, in such a way that they can move through a working travel towards and away from the column 2. The embodiment shown in FIG. 2 employs three slides 4, two on the sides and one at the rear of the column 2. The slide 4 at the rear of the column is partly hidden to FIG. 2 by one of the slides 4 at the side. The slides 4 at the sides of the column 2 each deliver two staples to the column, whereas the slide 4 at the rear delivers a single staple.

In the preferred embodiment illustrated, each of the slides 4 is mounted on an oscillating arm 5 and the displacement means 6 is constituted in each case by a pneumatic cylinder which operates to produce pivotal motion of the arm 5 to effect the working travel of the corresponding slide, whilst the loading means is in each case constituted by another pneumatic cylinder 7 connected to the slide 4, although other possible embodiments are conceivable, such as, for example, the arrangement of the slides 4 in a guided relationship on supporting rails, the arms 5 in all cases being mounted on the apparatus through appropriate seating arrangements 8 which enable them to be positioned so as to facilitate their adjustment in relation to the column.

Figure 3:
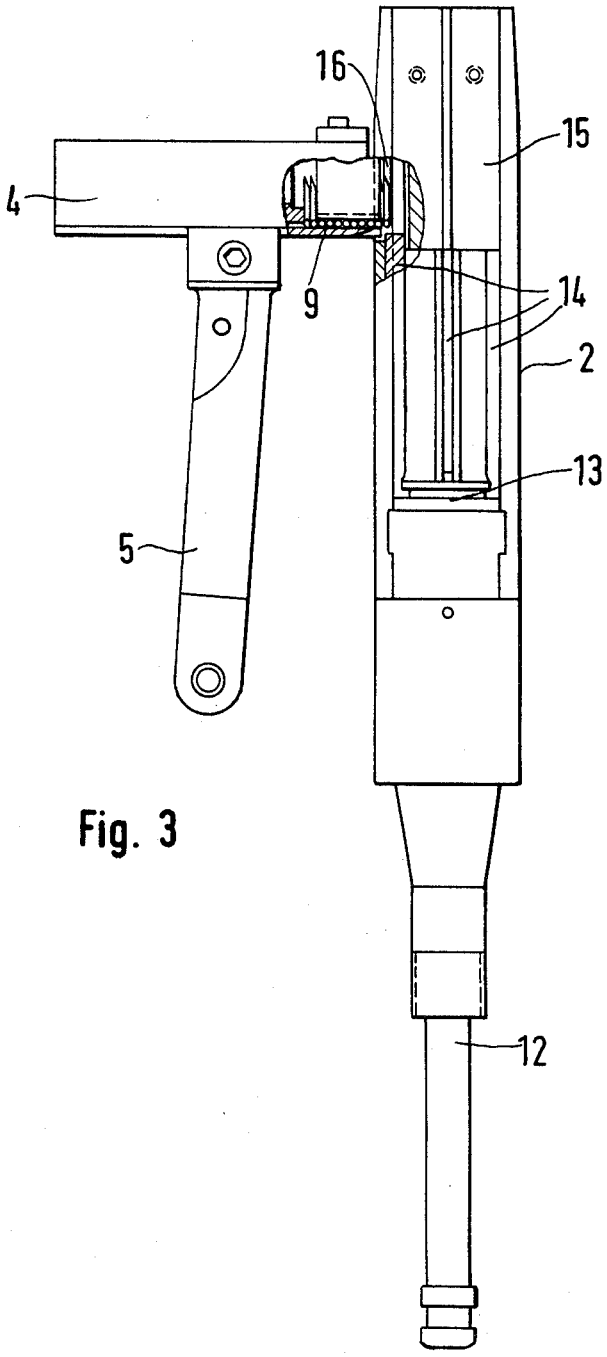
FIGS. 3, 4 and 5 are similar front views of part of the apparatus of FIG. 1 showing the main column and one staple feeding means during the successive stages of the operation of the apparatus.
Figure 4:
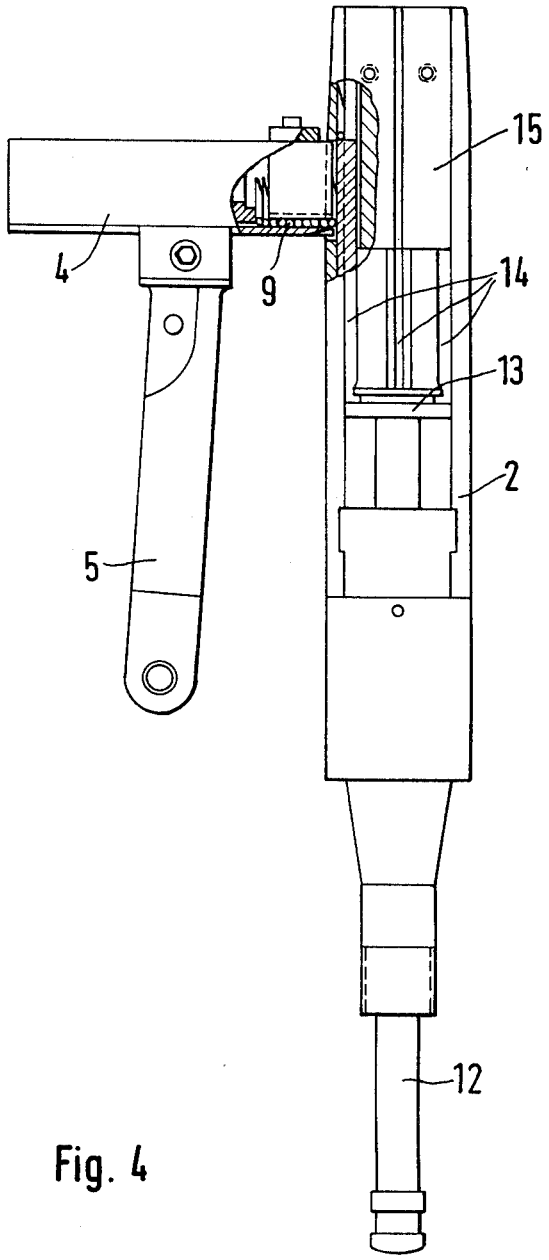
Figures 5, 6:
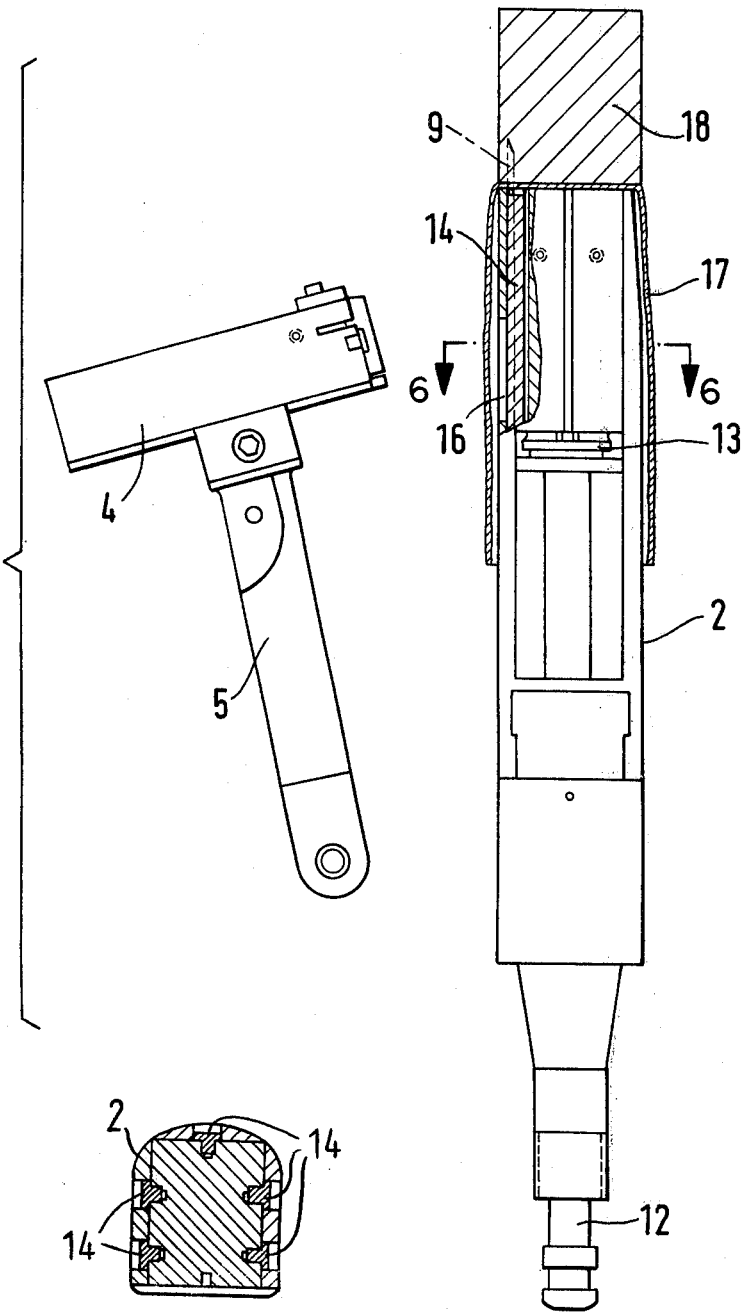
FIG. 6 shows a section taken along the line 6—6 FIG. 5.

The feeding of the staples into the column is effected before the item of footwear is placed on the column by actuating the displacement means 6 in such a way as to move the slides 4 towards the column until they abut against the lateral openings 16 therein, the loading means 7 and the pushrod 12 for the hammers being inoperative. The sequence of operation of all the working elements is illustrated in FIGS. 3 to 5. Although each working motion of the apparatus could be controlled by separate commands of an operator, the apparatus is preferably automatically sequenced through its steps using a control device of a type well known in the art and therefore not shown or described in detail.

The loading means 7 are coupled to the slides 4 which act synchronously on the sets of the staples 9 in order, in a subsequent stage to push the sets of staples 9 and to feed at least one of the staples of each set, into the corresponding opening 16.

Following the insertion of the staples 9 into the openings 16 in the column 2, the pushrod 12 advances part way upward. The hammers 14 thereby pick up the inserted staples 9 and move them part way up into the column 2, thereby firmly retaining them. The pushrod 12 then pauses for a predetermined time. The slides 4 are pivoted outward from the column 2 to free the sides of the column 2 in order that an item of footwear and a heel to be stapled (not shown) can be inverted thereon. At the end of the pause, the abutment 3 is lowered against the heel and the pushrod 12 and hammers 14 complete their upward travel. The staples are thus driven through the counter portion of the item of footwear into the heel.

It will be understood that the claims are intended to cover all changes and modifications of the preferred embodiments of the invention, herein chosen for the purpose of illustration which do not constitute departures from the spirit and scope of the invention.

I claim:

1. Apparatus for stapling an element to an item of footwear comprising:
   a. a base;
   b. a column attached to said base;
   c. said column having an upper portion shaped to conform to the counter portion of said footwear;
   d. a plurality of longitudinal slots in said column;
   e. a plurality of hammers moveable in said slots;
   f. means pivotably mounted exterior of said column for loading one staple into each of said plurality of longitudinal slots;
   g. means for moving said means for loading into abutment with said column prior to said loading and clear of said column after said loading; and
   h. means for driving said hammers whereby said staples are driven along said slots into said footwear and said element.

2. Apparatus as recited in claim 1 wherein each of said means for loading comprises:
   a. an arm pivoted to said base;
   b. a slide attached to said arm;
   c. said slide being adapted to containing a plurality of staples; and
   d. means for feeding at least one staple into said column.

3. Apparatus as recited in claim 2 wherein said means for driving, means for moving, means for pivoting and means for feeding are operated by hydraulic pressure.

* * * * *